US008041470B2

(12) United States Patent
Kyuma

(10) Patent No.: US 8,041,470 B2
(45) Date of Patent: Oct. 18, 2011

(54) FAN OPERATION CONTROL METHOD AND APPARATUS

(75) Inventor: Takahide Kyuma, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 395 days.

(21) Appl. No.: 12/329,913

(22) Filed: Dec. 8, 2008

(65) Prior Publication Data

US 2009/0164048 A1 Jun. 25, 2009

(30) Foreign Application Priority Data

Dec. 20, 2007 (JP) ..... 2007-329060

(51) Int. Cl.

| | |
|---|---|
| ***G05D 1/00*** | (2006.01) |
| ***F01P 7/10*** | (2006.01) |
| ***F01P 7/04*** | (2006.01) |
| ***B60Q 1/00*** | (2006.01) |
| ***H02J 7/00*** | (2006.01) |

(52) U.S. Cl. ... 701/1; 123/41.49; 123/41.48; 123/41.65; 340/449; 320/134

(58) Field of Classification Search ..... 340/449, 340/441, 438, 450.3, 460; 123/41.12, 41.15, 123/41.31, 41.48, 41.49, 41.1, 41.01, 41.02; 701/1; 320/134; 236/35; 62/133, 184, 183, 62/186; 165/202, 287, 41, 42, 43

See application file for complete search history.

(56) References Cited

U.S. PATENT DOCUMENTS

| | | | | |
|---|---|---|---|---|
| 4,475,485 | A * | 10/1984 | Sakakibara et al. | 123/41.05 |
| 5,826,671 | A * | 10/1998 | Nakae et al. | 180/65.235 |
| 6,131,533 | A * | 10/2000 | Sugiyama et al. | 118/723 E |
| 6,178,938 | B1 * | 1/2001 | Suzuki | 123/142.5 R |
| 6,397,807 | B1 * | 6/2002 | Suzuki | 123/142.5 R |
| 6,497,224 | B2 * | 12/2002 | Suzuki | 123/551 |
| 2004/0102892 | A1 * | 5/2004 | Aldrich et al. | 701/110 |
| 2007/0231119 | A1 * | 10/2007 | Shen et al. | 415/47 |
| 2008/0164989 | A1 * | 7/2008 | Easton | 340/449 |
| 2009/0122444 | A1 * | 5/2009 | Ma et al. | 360/97.02 |

FOREIGN PATENT DOCUMENTS

| | | | |
|---|---|---|---|
| JP | 61-070149 | A | 4/1986 |
| JP | 61-104130 | A | 5/1986 |
| JP | 02-042118 | A | 2/1990 |
| JP | 4-187813 | A | 7/1992 |
| JP | 2006-097648 | A | 4/2006 |
| JP | 2006-125217 | A | 5/2006 |
| KR | 10-20020059546 | * | 7/2002 |

* cited by examiner

*Primary Examiner* — James P Trammell
*Assistant Examiner* — Muhammad Shafi
(74) *Attorney, Agent, or Firm* — Sughrue Mion, PLLC

(57) ABSTRACT

An outside air temperature of a vehicle is detected, an operating time of a fan is set in accordance with the detected outside air temperature based on a fan operating time map, and an idle speed increase time is set in accordance with the an operating time based on an idle speed increase time map.

3 Claims, 7 Drawing Sheets

FIG. 5A
FAN OPERATING TIME MAP
| OUTSIDE AIR TEMPERATURE(°C) | 35 | 36 | 37 | 38 | 39 | 40 |
|---|---|---|---|---|---|---|
| FAN OPERATING TIME(sec) | 0 | 60 | 180 | 480 | 480 | 480 |
FIG. 5B
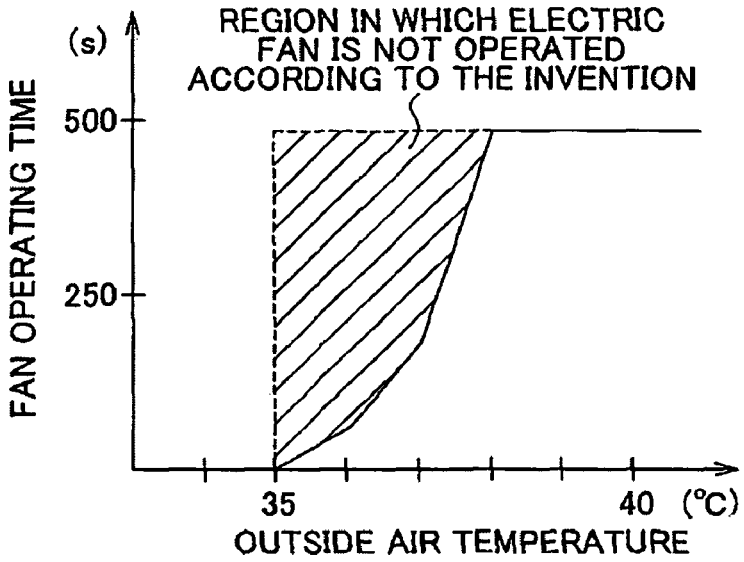
FIG. 5C
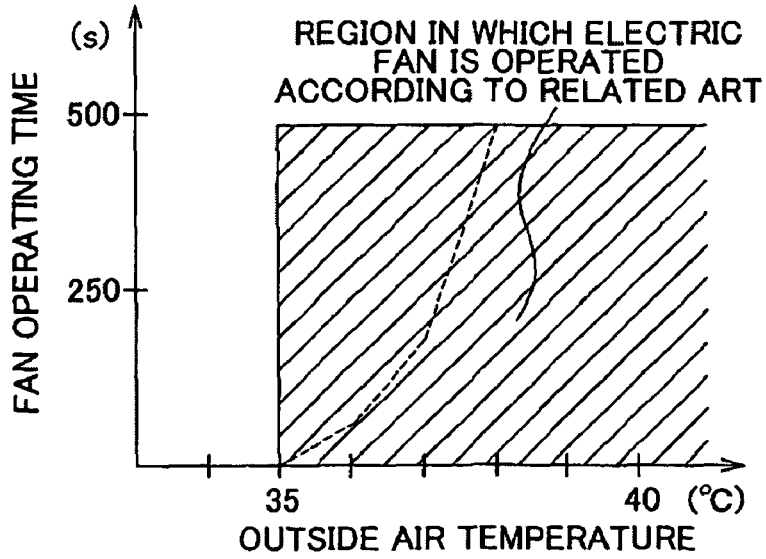

FIG. 7

IDLE SPEED INCREASE TIME MAP

| FAN OPERATING TIME(sec) | 0 | 60 | 180 | 480 |
|---|---|---|---|---|
| IDLE SPEED INCREASE TIME(sec) | 0 | 96 | 288 | 768 |

FAN OPERATION CONTROL METHOD AND APPARATUS

INCORPORATION BY REFERENCE

The disclosure of Japanese Patent Application. No. 2007-329060 filed on Dec. 20, 2007 including the specification, drawings and abstract is incorporated herein by reference in its entirety.

BACKGROUND OF THE INVENTION

1. Field of the Invention

The invention relates to a fan operation control method and apparatus to control an operating time of an electric fan that cools an internal combustion engine after the internal combustion engine is stopped and an idle speed increase time required for charging the battery.

2. Description of the Related Art

Typically, an internal combustion engine mounted on a vehicle, for example, is relatively hot immediately after the internal combustion engine is stopped. If the internal combustion engine is restarted under such circumstances, fuel in a fuel pipe of a fuel injection system becomes hot (for example, approximately 100° C.), and therefore, bubbles (fuel vapor) are formed and thus the amount of fuel injected is reduced. This makes an air-fuel ratio in each cylinder significantly leaner than a desired air fuel ratio, which can result in unstable engine speed during idling operation (hereinafter referred to as "idle speed") and can significantly reduce startability of the internal combustion engine. For this reason, it has been proposed to cool an internal combustion engine by operating a fan for a predetermined time after the internal combustion engine is stopped.

As a method to cool the internal combustion engine as described above, a method of controlling a fan motor has been proposed in which an operating time of the fan is calculated using the amount of energy supplied to the internal combustion engine and characteristic values of the fan (for example, refer to Published Japanese Translation of PCT Application No. 2006525462 (JP-A-2006-525462)).

In the control method as proposed above, the operating time of the fan required after the internal combustion engine is stopped is calculated based on an integral value of the measured amount of energy supplied to the internal combustion engine before the internal combustion engine is stopped, and on operational data and ambient environmental data of the internal combustion engine at the present time. After the internal combustion engine is stopped, the fan is operated using electric power supplied from the battery. Then, the electric power of the battery consumed after the internal combustion engine is stopped is compensated by charging the battery using electric power generated by an electric generator that is driven to rotate by the internal combustion engine after the internal combustion engine is restarted.

On the other hand, even during normal operation of the internal combustion engine, if an electrical component that consumes a large amount of electricity is used during idling, the capacity of the electric generator becomes insufficient to cover the electric load required to supply electricity to the electrical component at the normally set idle speed. Therefore, a technology has been proposed in which the set idle speed is corrected to increase as the electric load increases (for example, refer to Japanese Patent Application Publication No. 61-70149 (JP-A-61-70149)).

According to the technology described above, detection means for detecting charge/discharge condition of the battery is provided, and when the detection means detects that the battery is discharging due to increase of the electric load, control means corrects the idle speed to increase.

However, according to the technology described in JP-A-2006-525462, the operating time of the fan is calculated based on the amount of energy supplied to the internal combustion engine and the characteristic values of the fan. It is difficult to accurately measure these values, and as a result, it is also difficult to calculate the fan operating time. Further, according to the technology described in JP-A-2006-525462, because the operating time of the fan after the internal combustion engine is stopped fluctuates, it is not possible to effectively charge the battery to compensate for the decrease in the battery charge amount. For example, if a battery charging time is set in order to sufficiently charge the battery at all times, the battery is unnecessarily charged when the operating time of the fan is short.

Further, according to the technology described in JP-A-61-70149, it is detected whether the battery is discharging due to increase in the electric load. If it is detected that the battery is discharging, the idle speed is corrected to increase. Therefore, a plurality of devices, such as a comparator and a delay circuit, are required, and further, a complicated circuit is also required. Further, according to the technology described in JP-A61-70149, the idle speed can be increased only when the battery is discharging, and it is not possible to deal with the decrease in the battery charge amount after the internal combustion engine is stopped.

SUMMARY OF THE INVENTION

The invention provides a fan operation control method and apparatus with which it is possible to easily calculate the operating time of the fan and the time required for charging the battery, and it is also possible to suppress noise, improve safety, and extend the lifetime of the battery by reducing unnecessary operations of the fan.

A fan operation control method according to a first aspect of the invention includes: storing a fan operating time map based on which an operating time of a fan is set in accordance with an outside air temperature of a vehicle and an idle speed increase time map based on which an idle speed increase time is set in accordance with the operating time of the fan; detecting the outside air temperature of the vehicle; detecting an operation stop command of an internal combustion engine that is cooled by the fan; setting the operating time of the fan in accordance with the outside air temperature of the vehicle based on the fan operating time map when the operation stop command of the internal combustion engine is detected; storing the set operating time of the fan in a non-volatile memory; controlling the fan to operate for the set operating time of the fan using electric power supplied from a battery; detecting an operation start command of the internal combustion engine; searching the non-volatile memory when the operation start command of the internal combustion engine is detected, and setting time to increase an idle speed in accordance with the set operating time of the fan based on the idle speed increase time map when the operating time of the fan is set and stored in the non-volatile memory; and increasing the idle speed of the internal combustion engine for the set time so as to charge the battery.

In this configuration, the operating time of the fan is set in accordance with the outside air temperature based on the fan operating time map, and the idle speed increase time is set in accordance with the set fan operating time based on the idle speed increase time map. This makes it possible to easily calculate the fan operating time and the idle speed increase time for charging the battery, and further, this also makes it possible to reduce operations that are not required and to shorten the idle speed increase time, whereby unnecessary operations are reduced. Thus, it is possible to suppress noise, and improve safety and extend the lifetime of the battery by shortening the operating time.

Further, when the operating time of the fan is set in accordance with the outside air temperature of the vehicle, if the detected outside air temperature of the vehicle does not match any temperature stored in the fan operating time map, the operating time of the fan corresponding to the detected outside air temperature may be interpolated based on other information set in the fan operating time map.

Further, when the detected outside air temperature of the vehicle does not match any temperature stored in the fan operating time map, the fan operating time is calculated so as to correspond to the detected outside air temperature, based on other values of the fan operating time stored in the fan operating time map, whereby the fan operating time map covers all the possible outside air temperatures even when the fan operating time map is not set to cover all the possible outside air temperatures. Further, it is possible to reduce the data size of the fan operating time map. As a result, it is possible to reduce the capacity of memory required for storing the data.

A fan operation control apparatus according to a second aspect of the invention includes: an operating time map storing portion that stores a fan operating time map based on which an operating time of a fan is set in accordance with an outside air temperature of a vehicle and an idle speed increase time map based on which an idle speed increase time is set in accordance with the operating time of the fan; an outside air temperature detection portion that detects the outside air temperature of the vehicle; an internal combustion engine operation command detection portion that detects an operation stop command and an operation start command of an internal combustion engine that is cooled by the fan; a fan operating time setting portion that sets the operating time of the fan in accordance with the outside air temperature of the vehicle based on the fan operating time map when the operation stop command of the internal combustion engine is detected; a fan operating time storing portion that stores the set operating time of the fan in a non-volatile memory; a fan operation control portion that controls the fan to operate for the set operating time of the fan using electric power supplied from a battery, an idle speed increase time setting portion that searches the non-volatile memory when the operation start command of the internal combustion engine is detected, and that sets time to increase an idle speed in accordance with the set operating time of the fan based on the idle speed increase time map when the operating time of the fan is set and stored in the non-volatile memory; and an idle speed increase portion that increases the idle speed of the internal combustion engine for the set time so as to charge the battery.

In this configuration, the operating time of the fan is set in accordance with the outside air temperature based on the fan operating time map, and the idle speed increase time is set in accordance with the set fan operating time based on the idle speed increase time map. This makes it possible to easily calculate the fan operating time and the idle speed increase time for charging the battery, and further, this makes it possible to reduce operations of the electric fan that are not required and to shorten the idle speed increase time, whereby unnecessary operations are reduced. Thus, it is possible to suppress noise, and improve safety and extend the lifetime of the battery by shortening the operating time.

A fan operation control method according to a third aspect of the invention includes: detecting an outside air temperature, and determining a fan operating time based on the detected outside air temperature; operating a fan for the determined fan operating time when an internal combustion engine is stopped; determining an idle speed of the internal combustion engine based on the fan operating time; and increasing the idle speed of the internal combustion engine for the determined idle speed increase time when the internal combustion engine is restarted.

A fan operation control apparatus according to a fourth aspect of the invention includes: a fan operating time setting portion that detects an outside air temperature, and determines a fan operating time based on the detected outside air temperature; a fan operation control portion that operates a fan for the determined fan operating time when an internal combustion engine is stopped; an idle speed increase setting portion that determines an idle speed of the internal combustion engine based on the fan operating time; and an idle speed increase portion that increases the idle speed of the internal combustion engine for the determined idle speed increase time when the internal combustion engine is restarted.

The fan operating time may be set longer at a first outside-air temperature, which is higher than a second outside air temperature, compared to the fan operating time at the second outside air temperature.

The fan operating time may be set constant when the outside air temperature is higher than the first outside air temperature.

The idle speed increase time may be set longer at the first outside air temperature, compared to the idle speed increase time at the second outside air temperature.

According to the invention, because the operating time of the fan is set in accordance with the outside air temperature based on the fan operating time map, and the idle speed increase time is set in accordance with the set fan operating time based on the idle speed increase time map, it is possible to provide fan operation control method and apparatus with which it is possible to easily calculate the fan operating time and the idle speed increase time for charging the battery, and further, it is possible to suppress noise, and improve safety and extend the lifetime of the battery by reducing unnecessary operations.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein:

FIG. 5A is a fan operating time map according to the embodiment of the invention, FIG. 5B is a graph showing a fan operating time set based on the fan operating time map according to the embodiment of the invention, and FIG. 5C is a graph showing the fan operating time set based on the fan operating time map according to a related art;

FIG. 7 is an idle speed increase time map according to the embodiment of the invention.

DETAILED DESCRIPTION OF THE EXAMPLE EMBODIMENTS

Figure 1:
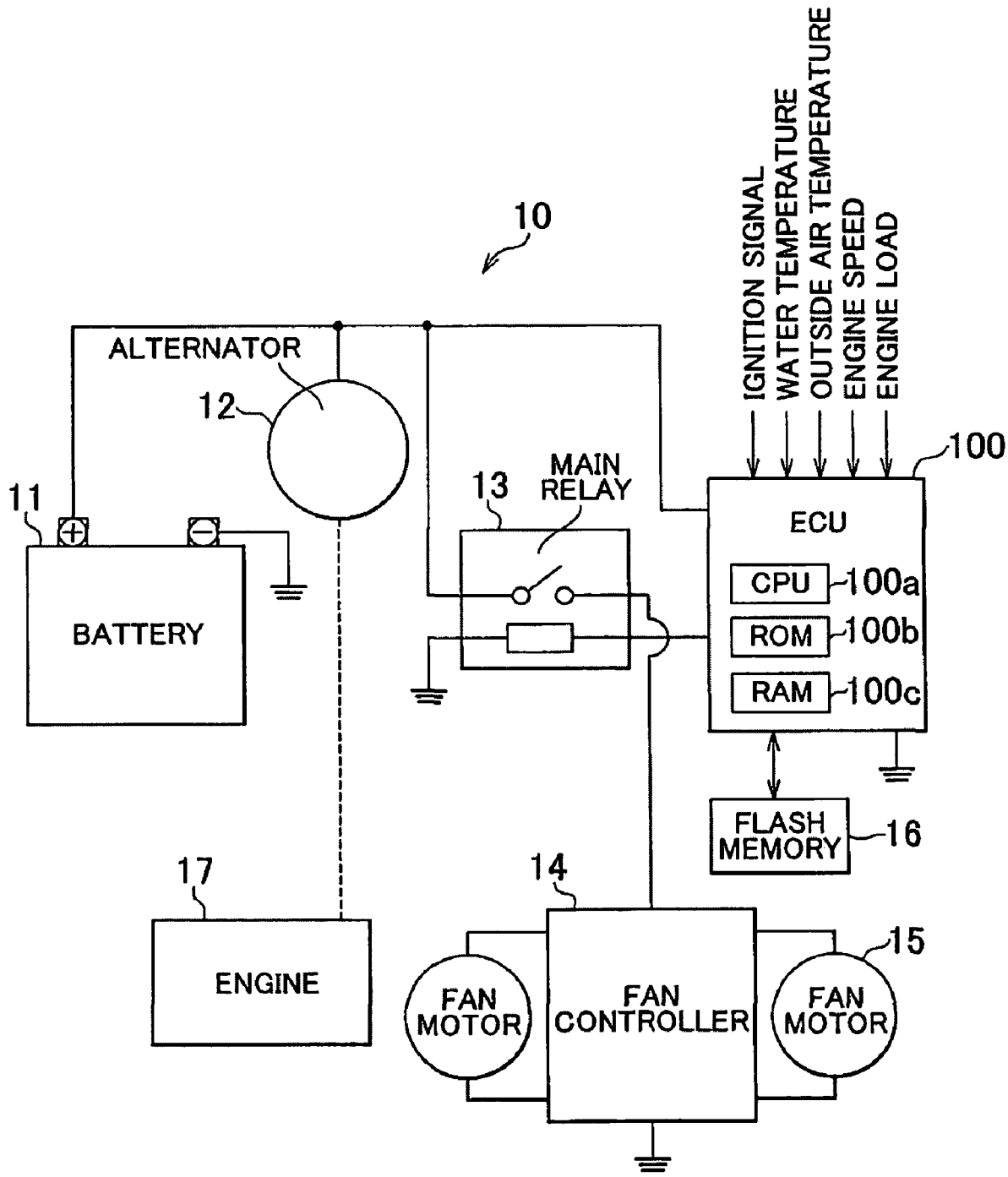
FIG. 1 is a schematic block diagram showing a vehicle to which a fan operation control apparatus according to an embodiment of the invention is mounted.

An embodiment of the invention will be described with reference to the attached drawings. It should be noted that directional terms used in this specification, front and rear, for example, describe the directions with respect to a vehicle. First, the configuration of a vehicle to which a fan operation control apparatus according to the embodiment of the invention is mounted will be described. FIG. 1 is a block diagram schematically showing the vehicle to which the fan operation control apparatus according to the embodiment of the invention is mounted.

As shown in FIG. 1, acvehicle 10 includes: a battery 11 that functions as an electric accumulator; an alternator 12 that functions as an electric generator; a main relay 13 that opens and closes a circuit; a fan motor 15; a fan controller 14 that controls the fan motor 15; a flash memory 16 that is a non-volatile memory; an engine 17, which is an internal combustion engine; and a vehicle electronic control unit (hereinafter referred to as "ECU") 100 that controls the entire system of the vehicle 10.

The battery 11 is a rechargeable battery. The battery 11 supplies electric power to a starter when the engine 17 is started, and also supplies electric power to electrical components, etc. The battery 11 is charged by the alternator 12. Typically, a 12V lead-acid battery is employed as the battery 11 for the use in automobiles. The lead-acid battery is formed of electrolyte and two different types of electrodes, etc., and converts chemical energy into electric energy. On the other hand, when electric energy is supplied from the outside to the lead-acid battery, the lead-acid battery converts the electric energy into chemical energy and stores the chemical energy converted. More specifically, the lead-acid battery is formed by placing a lead dioxide plate and a lead plate in dilute sulfuric acid, and ions of lead, hydrogen, and sulfuric acid cause an electric current to flow from a positive electrode to a negative electrode, thereby generating electricity. On the other hand, when electric energy is supplied from the outside, the electric energy is converted to chemical energy, and the chemical energy converted is stored in the lead-acid battery.

The alternator 12 is an electric generator that generates electric power required for operating the vehicle 10. The alternator 12 includes a rotor, around which a wire is wound. The alternator 12 also includes: a stator coil that is provided around the rotor; a rectifier that converts alternating current into direct current; and a regulator that adjusts the amount of electricity generated. The rotor acts as an electromagnet when the battery 11 causes electric current to flow through the wire wound around the rotor. Further, a crankshaft of the engine 17 and the rotor of the alternator 12 are connected to each other by a belt.

When the engine 17 is started and the crankshaft of the engine 17 starts to rotate, the rotary motion of the crankshaft of the engine 17 is transmitted to the rotor of the alternator 12 through the belt. During this, if electricity is supplied to the wire wound around the rotor of the alternator 12, the rotor acts as the electromagnet, and is rotated by the rotary motion transmitted from the crankshaft of the engine 17, whereby alternating current is generated on a conductor of the stator coil through electromagnetic induction. The rectifier converts the alternating current generated into direct current, and the regulator adjusts the amount of current, whereby electricity is output from the alternator 12.

Electricity generated by the alternator 12 is supplied to electrical components, etc., and if there is surplus of generated electricity, the surplus is used for charging the battery 11.

The main relay 13 includes a coil that acts as an electromagnet when an electric current flows through the coil, and a switch that is operated by the magnetic force so as to open and close the circuit. In the main relay 13, current flowing through the coil is controlled by the ECU 100, and when electric current flows through the coil, the coil acts as an electromagnet, and the switch is attracted by the magnetic field produced by the coil, whereby the circuit is closed. In this way, the current flow of the coil is controlled by the ECU 100, and the switch is switched between ON and OFF so as to open and close the circuit.

Further, the main relay 13 employs a means using an electromagnet, which is called as an electromagnetic means or a mechanical means. However, the main relay 13 may employ a semiconductor means in which the circuit is opened and closed using a semiconductor.

The fan controller 14 operates the fan motor 15 so as to operate an electric fan, which will be described later. The flash memory 16 is a non-volatile memory in which stored data is not affected even when the power supply to the memory is stopped. The flash memory 16 is rewritable, and is designed so that the stored data is not lost even when the power supply is stopped. The flash memory 16 is connected to the ECU 100, and the ECU 100 writes and reads data into and from the flash memory 16.

The engine 17 is an internal combustion engine that outputs power using hydrocarbon fuel, such as gasoline and diesel oil. The ECU 100 performs operational control of the engine 17, such as fuel injection timing control, ignition timing control, and intake air amount adjustment control, based on signals input to the ECU 100 from various sensors that detect operational conditions of the engine 17. Further, the engine 17 is cooled by cooling water that has been cooled in a radiator, which will be described later.

As shown in FIG. 1, the ECU 100 is a microprocessor that includes a central processing unit (CPU) 100*a* as a main component, and in addition to the CPU 100*a*, the ECU 100 includes a read-only memory (ROM) 100*b* that stores, for example, processing programs, and a random access memory (RAM) 100*c* that temporally stores data. Further, the ECU 100 includes an input port, an output port, and a communication port, which are not shown in the drawings.

The ECU 100 receives, through the input port, signals such as an ignition signal and an engine stop signal output from an ignition switch (not shown), a water temperature detection signal output from a water temperature sensor that detects a cooling water temperature of the engine 17, an outside air temperature detection signal output from an outside air temperature sensor that detects the air temperature outside of the vehicle 10, an engine speed detection signal output from an engine speed sensor that measures the engine speed of the engine 17, and an engine load signal that indicates the condition of the engine 17.

The ECU 100 is connected to the battery 11 and the alternator 12, and receives electric power supplied from the battery 11 or the alternator 12. Further, the ECU 100 controls the main relay 13 so as to open and close the circuit. In other words, the ECU 100 controls electric power supplied to the fan controller 14.

As described above, the ECU 100 is connected to the flash memory 16 through the communication port so as to exchange data therebetween. Further, the ROM 100*b* stores a fan operating time map based on which an operating time of the electric fan (hereinafter simply referred to as "fan operating time") is set in accordance with the outside air temperature of the vehicle 10, and an idle speed increase time map based on which an idle speed increase time is set in accordance with the fan operating time. It should be noted that the term, "idle speed increase" indicates a correction to increase the set idle speed.

Figure 2:
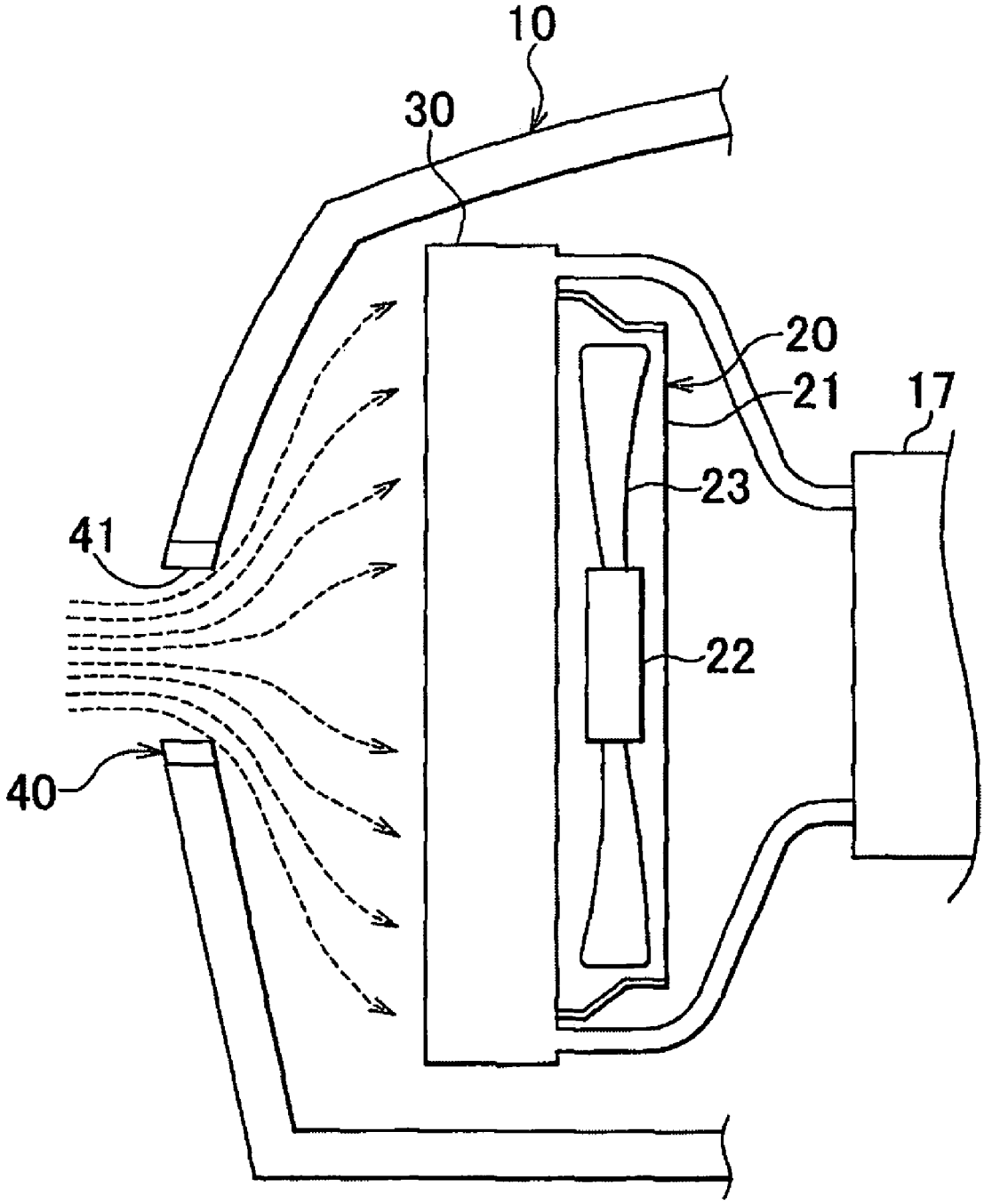
FIG. 2 is a cross-sectional view showing a front portion of an engine room of the vehicle according to the embodiment of the invention.

Next, the electric fan and the radiator provided in the engine room will be described. FIG. 2 is a cross-sectional view showing a front portion of the engine room of the vehicle 10 according to the embodiment of the invention, and FIG. 3 is a plan view showing the front portion of the engine room of the vehicle 10 according to the embodiment of the invention.

Figure 3:
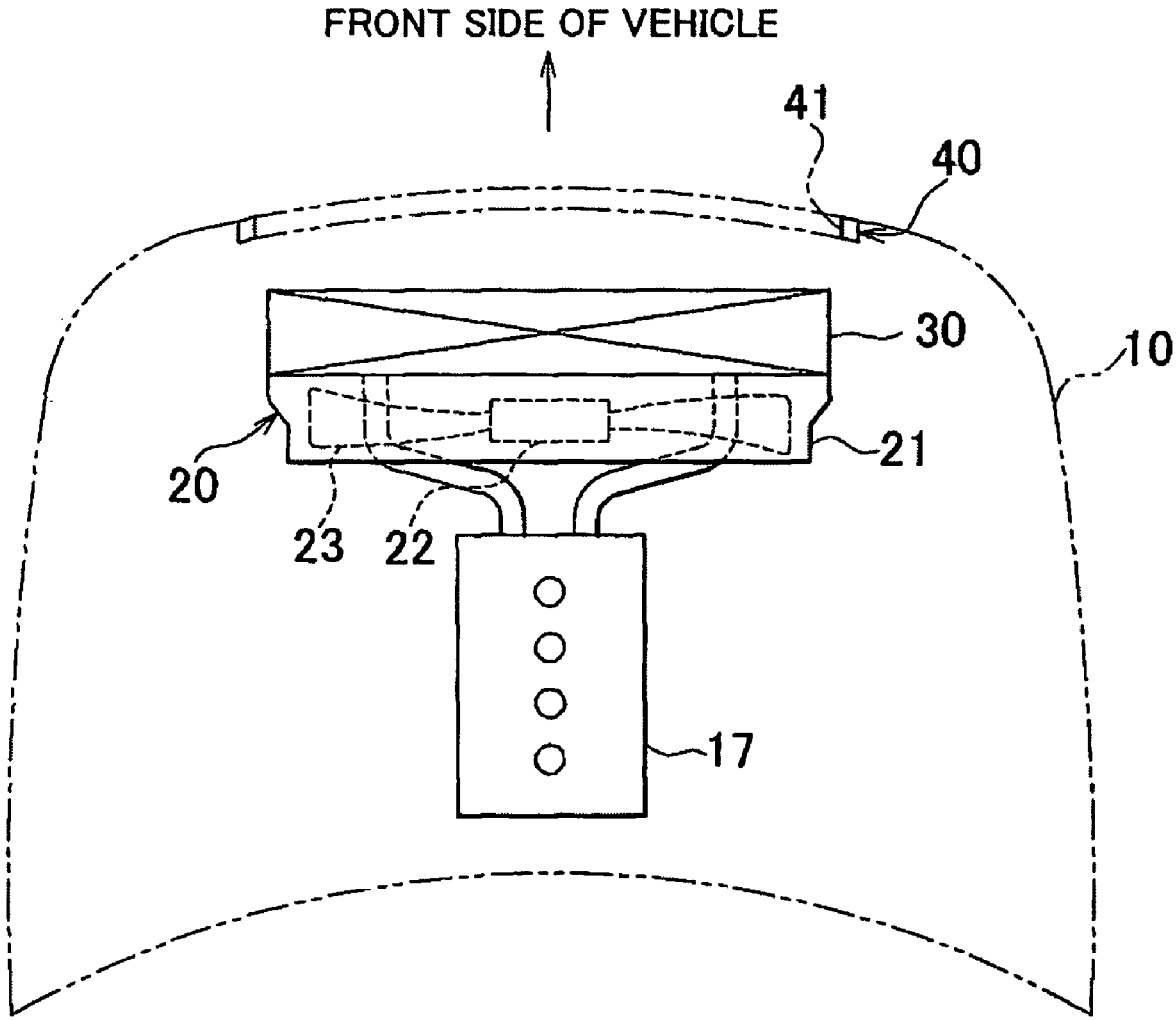
FIG. 3 is a plan view showing the front portion of the engine room of the vehicle according to the embodiment of the invention.

As shown in FIGS. 2 and 3, a radiator 30 is provided in the front portion of the vehicle 10, and an electric fan 20 is provided at the rear of the radiator 30. The radiator 30 includes a cooling passage therein, and the cooling passage has a surface with a large contact surface area that is exposed to the outside of the radiator 30. The cooling water that cooled the engine 17 passes through the cooling passage in the radiator 30.

Further, a radiator grill 40 is provided around the center of a front end portion of the vehicle 10, and is disposed in front of the radiator 30. The radiator grill 40 includes grill openings 41 that function as inlet openings for the wind caused by running of the vehicle, and the running wind is introduced through the grill openings 41. The running wind introduced through the grill openings 41 is sent to the radiator 30 by the electric fan 20 so as to cool the cooling water flowing through the radiator 30.

The electric fan 20 includes a propeller 23 that has a boss portion 22 at the center of the propeller 23, and the boss portion 22 is connected to a shaft of the fan motor 15 so that the propeller 23 rotates as the shaft of the fan motor 15 (not shown) rotates. The fan motor 15 is supported by a fan shroud 21 that is attached to a rear surface of the radiator 30.

In this configuration, when the vehicle 10 is running, the cooling water in the radiator 30 is cooled by the running wind introduced through the grill openings 41 provided in the radiator grill 40. On the other hand, when the vehicle 10 is stopped, it is difficult to cool the cooling water in the radiator 30 because the running wind is not produced and is not introduced through the grill openings 41 provided in the radiator grill 40. However, if the electric fan 20 is operated, the outside air of the vehicle 10 is actively introduced through the grill openings 41 provided in the radiator grill 40 and is sent to the radiator 30, thereby cooling the cooling water in the radiator 30.

Therefore, even when the vehicle 10 is stopped, it is possible to actively cool the engine 17 by operating the electric fan 20 to cool the cooling water in the radiator 30.

It should be noted that, in the embodiment, the electric fan 20 is provided at the rear of the radiator 30. However, the electric fan 20 may be provided in front of the radiator 30. Further, in the embodiment, the cooling water in the radiator 30, which is used for cooling the engine 17, is cooled by the electric fan 20, so that the engine 17 is indirectly cooled by the electric fan 20. However, the engine 17 may be directly cooled by the electric fan 20.

Next, the characteristic features of the vehicle 10 to which the fan operation control apparatus according to the embodiment of the invention is mounted will be described.

The ECU 100 detects the outside air temperature of the vehicle 10. In other words, the ECU 100 functions as an outside air temperature detection portion according to the invention. Further, the ECU 100 detects the stop signal (indicative of operation stop command) and the ignition signal (indicative of operation start command) of the engine 17 that is cooled by the electric fan 20. In other words, the ECU 100 functions as an internal combustion engine operation command detection portion according to the invention.

Further, the ECU 100 sets the operating time of the electric fan 20 in accordance with the outside air temperature of the vehicle 10 based on the fan operating time map when the ECU 100 detects the stop signal of the engine 17. In other words, the ECU 100 functions as a fan operating time setting portion according to the invention. Further, the ECU 100 controls the flash memory 16 to store the fan operating time set as described above. In other words, the ECU 100 functions as a fan operating time storing portion according to the invention.

Further, the ECU 100 controls the electric fan 20 to operate using electric power supplied from the battery 11 for the fan operating time set as described above. In other words, the ECU 100 functions as a fan operation control portion according to the invention. Further, when the ignition signal is detected, the ECU 100 searches the stored data in the flash memory 16, and if the fan operating time is set and stored, the ECU 100 sets the idle speed increase time in accordance with the set fan operating time based on the idle speed increase time map. In other words, the ECU 100 functions as an idle speed increase time setting portion according to the invention.

Further, the ECU 100 controls the idle speed of the engine 17 to increase during the idle speed increase time set as described above, and controls the alternator 12 to charge the battery 11. In other words, the ECU 100 functions as an idle speed increase portion according to the invention.

Further, the ROM 100*b* of the ECU 100 stores the fan operating time map based on which the operating time of the electric fan 20 is set in accordance with the outside air temperature of the vehicle 10, and the idle speed increase time map based on which the idle speed increase time is set in accordance with the set fan operating time. In other words, the ROM 100*b* of the ECU 100 functions as an operating time map storing portion according to the invention.

Next, operation of the ECU 100 will be described. First, the ECU 100 controls the ROM 100*b* to store the fan operating time map based on which the operating time of the electric fan 20 is set in accordance with the outside air temperature of the vehicle 10, and to store the idle speed increase time map based on which the idle speed increase time is set in accordance with the set fan operating time.

Figure 4:
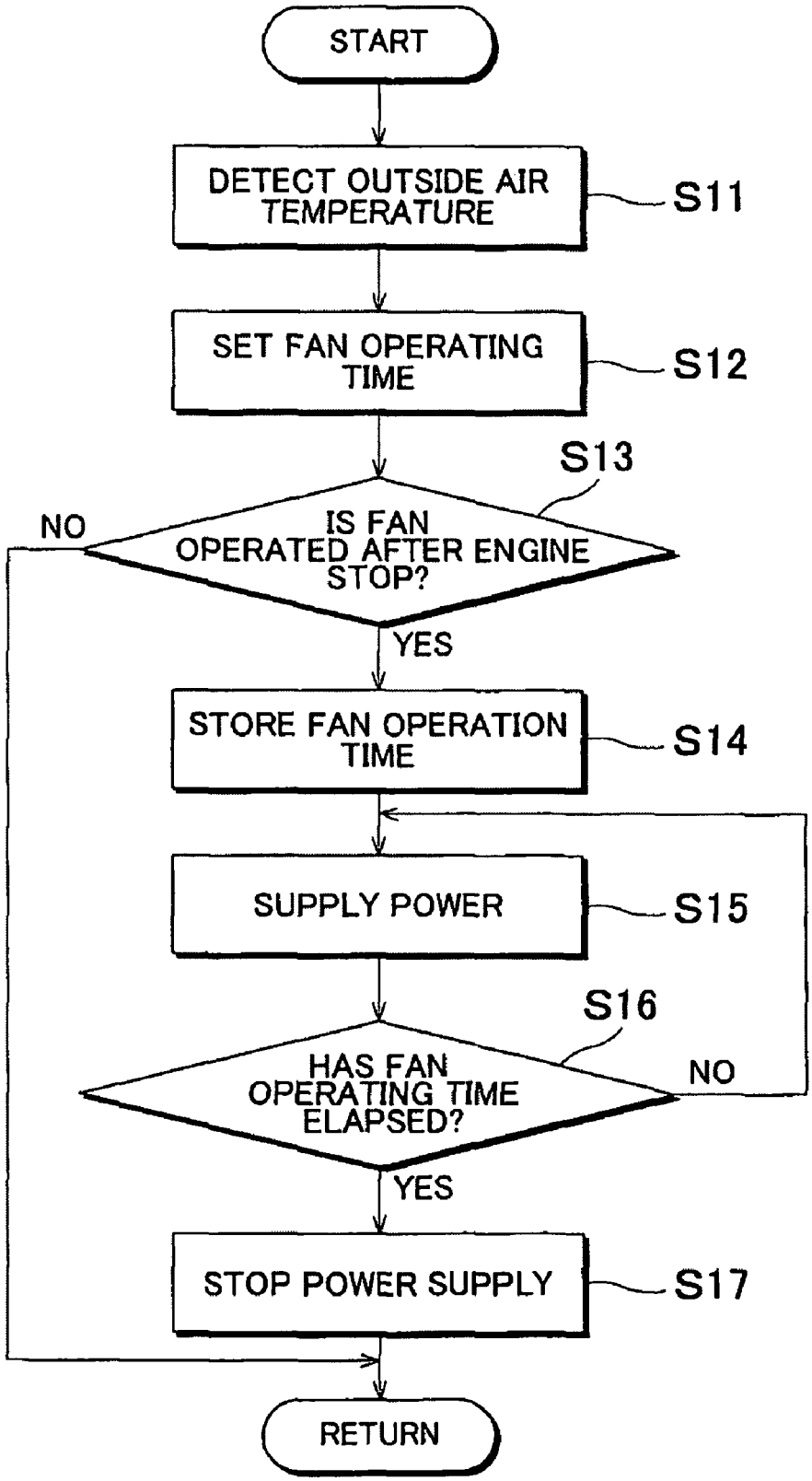
FIG. 4 is a flowchart showing a fan operation control process according to the embodiment of the invention performed when an engine is stopped.

FIG. 4 is a flowchart showing a fan operation control process according to the embodiment of the invention performed when the engine 17 is stopped.

It should be noted that the flowchart shown in FIG. 4 is a program for the fan operation control process performed by the CPU 100*a* of the ECU 100 when the engine 17 is stopped, and the ROM 100*b* stores the program for the fan operation control process performed when the engine 17 is stopped. The CPU 100*a* of the ECU 100 determines whether the engine stop signal output is received from the ignition switch, and if the CPU 100*a* detects that the engine stop signal is received, the fan operation control process as described above is performed.

The CPU 100*a* of the ECU 100 may repeatedly perform the fan operation control process in predetermined cycles, in which it is determined whether the engine stop signal is received or not in the first step.

In the fan operation control process performed when the engine is stopped, as shown in FIG. 4, when the engine stop signal, is input to the ECU 100 from the ignition switch, the ECU 100 detects the outside air temperature (in step S11). The ECU 100 detects the outside air temperature of the vehicle 10 based on the outside air temperature signal output from the outside air temperature sensor. In the embodiment, the process in step S11 functions as a process of detecting an outside air temperature of the vehicle according to the invention.

Next, the ECU 100 sets the operating time of the electric fan 20 in accordance with the outside air temperature of the vehicle 10 based on the fan operating time map stored in the ROM 100*b* (step S12). In the embodiment, the process in step S12 functions as a process of setting the operating time of the fan according to the invention.

FIG. 5A shows the fan operating time map according to the embodiment of the invention, and FIG. 5B is a graph showing the fan operating time set based on the fan operating time map according to the embodiment of the invention. For comparison with the fan operating time according to the embodiment, FIG. 5C shows a graph of the fan operating time set by a fan operation control method of the related art. As is evident from the graph shown in FIG. 5C, the hatched region in the graph shown in FIG. 5B indicates the difference between the fan operating time set by the fan operation control method of the related art and the fan operating time set by the fan operation control method according to the invention. In other words, the electric fan 20 is not operated in the hatched region shown in FIG. 5B. Accordingly, as it will be described later in detail, with the fan operation control method of the invention, the fan operating time is shortened by the time indicated by the hatched region in the graph shown in FIG. 5B, and therefore, unnecessary operation of the electric fan 20 is reduced.

The fan operating time map shown in FIG. 5A is just an example. As shown in FIG. 5A, when the outside air temperature is "35° C." or lower, the fan operating time is set to "0 second", that is, the electric fan 20 is not operated at all. If the outside air temperature is "38° C." or higher, the fan operating time is set to "480 seconds", and even if the outside air temperature is further increased, the fan operating time is not increased from the fan operating time set for 38° C.

Further, as shown in FIG. 5B, if the detected outside air temperature is the temperature that does not match any temperature set in the fan operating time map, the fan operating time for the detected outside air temperature is interpolated based on the values of the fan operating time set in the fan operating time map. For example, if the detected outside air temperature is a temperature between 35° C. and 38° C., the fan operating time corresponding to the detected outside air temperature is calculated based on the fan operating time values set for the temperatures immediately above and below the detected outside air temperature with the use of a proportion.

More specifically, for example, when the detected outside air temperature is "36.4° C.", the fan operating time for the detected outside air temperature is calculated in the following manner. First, the fan operating time values set for the outside air temperatures immediately above and below the detected outside air temperature are extracted from the fan operating time map. More specifically, the fan operating time values set for 36° C. and 37° C., that is, 60 seconds and 180 seconds, are extracted from the fan operating time map. Then, the fan operating time for the detected outside air temperature is calculated based on Equation 1 shown below using the proportion of the difference between the extracted values of the fan operating time to the difference between the outside air temperatures immediately above and below the detected outside air temperature.

$$(\text{Fan operating time at } 36.4^\circ\text{ C.})=60+(180-60)\times(0.4/(37-36))=108 \quad \text{[Equation 1]}$$

In this way, the fan operating time when the detected outside air temperature is 36.4° C. is calculated to be 108 seconds.

In the embodiment, if the detected outside air temperature is not included in the fan operating time map, the fan operating time for the detected outside air temperature is calculated on the assumption that, in the graph showing the fan operating time, the fan operating time for the detected outside air temperature is at some point on a straight line between the fan operating time values for the temperatures immediately above and below the detected outside air temperature. However, the invention is not limited to this. The fan operating time for the detected outside air temperature may be estimated using the fan operating time values for outside air temperatures other than the temperatures immediately above and below the detected outside air temperature. Further, an equation etc., used for calculation of the fan operating time may be set in the fan operating time map so that the equation can be used for any outside air temperatures.

Next, the ECU 100 determines whether the electric fan 20 needs to be operated after the engine 17 is stopped, that is, the ECU 100 determines whether the set fan operating time exceeds "0 second" (in step S13).

When it is determined in step S13 that the electric fan 20 needs not to be operated after the engine 17 is stopped (NO in step S13), that is, when it is determined that the fan operating time is "0 second", the fan operation control process performed when the engine 17 is stopped is terminated. Therefore, after the engine 17 is stopped, the control process is terminated without operating the electric fan 20.

On the other hand, when it is determined in step S13 that the electric fan 20 needs to be operated after the engine 17 is stopped (YES in step S13), that is, when the fan operating time exceeds "0 second", the fan operating time is stored in the flash memory 16 (in step S14). In the embodiment, the process in step S14 functions as a process of storing the set operating time of the fan in a non-volatile memory according to the invention.

Next, the ECU 100 allows an electric current to flow through the coil of the main relay 13 so that the circuit is closed by the main relay 13 and electric power is supplied to the fan controller 14, and at the same time, the ECU 100 starts a time counting process of the fan operating time (in step S15). When electric power is supplied to the fan controller 14, the fan controller 14 operates the fan motor 15, thereby operating the electric fan 20.

Next, the ECU 100 determines whether the fan operating time has elapsed (step S16). If the ECU 100 determines that the fan operating time has not elapsed yet, electric power is continuously supplied to the fan controller 14 until the fan operating time has elapsed (that is, as long as the determination result is NO in step S16). When the fan operating time has elapsed (YES in step S16), the current flowing through the coil of the main relay 13 is stopped, and the circuit is opened by the main relay 13 to stop electric power supply to the fan controller 14, and the time counting process of the fan operating time is terminated (in step S17). In this way, the fan operation control process performed when the engine 17 is stopped is terminated. As a result, the fan controller 14 stops operation of the fan motor 15, and thus the electric fan 20 stops operating. In the embodiment, the processes through step S15 to step S17 function as a process of controlling the fan to operate according to the invention.

As described above, it is possible to easily calculate the fan operating time that varies in accordance with the outside air temperature of the vehicle 10, and further, it is possible to operate the electric fan 20 for only the calculated fan operating time after the engine 17 is stopped.

Figure 6:
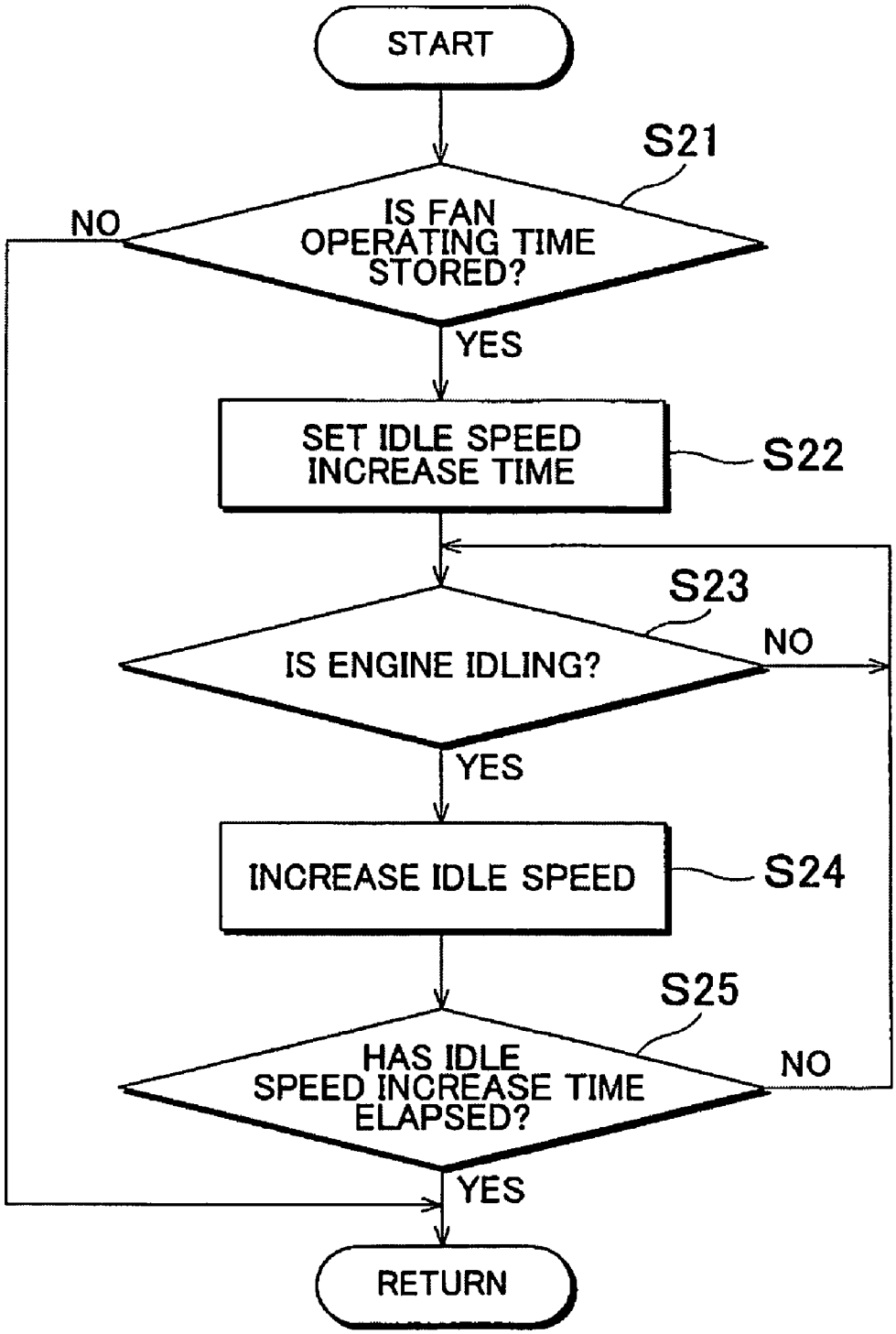
FIG. 6 is a flowchart showing a fan operation control process according to the embodiment of the invention performed when the engine is restarted.

Next, a fan operation control process performed when the engine 17 is restarted will be described. FIG. 6 is a flowchart showing the fan operation control process according to the embodiment of the invention performed when the engine 17 is restarted.

The flowchart shown in FIG. 6 corresponds to a program of the fan operation control process executed by the CPU 100*a* of the ECU 100 when the engine 17 is restarted. The ROM 100*b* stores the program of the fan operation control process performed when the engine 17 is restarted.

Further, the CPU 100*a* of the ECU 100 detects whether the ignition signal is received from the ignition switch, and if the CPU 100*a* determines that the ignition signal is received, the fan operation control process performed when the engine 17 is restarted is performed. In the embodiment, the process to detect the input of the ignition signal (that is, the operation start command of the engine 17) functions as a process of detecting an operation start command of the internal combustion engine according to the invention.

As shown in FIG. 6, the ECU 100 searches the stored data in the flash memory 16 when the ignition signal is received from the ignition switch, and determines whether the fan operating time is set (in step S21). If there is no set fan operating time-stored in the flash memory 16 (NO in step S21), the fan operation control process performed when the engine 17 is restarted is terminated.

On the other hand, if there is the set fan operating time stored in the flash memory 16 (YES in step S21), the idle speed increase time is set in accordance with the set fan operating time based on the idle speed increase map stored in the ROM 100*b* (in step S22). In the embodiment, the process in step S22 functions as a process of setting time to increase an idle speed according to the invention.

FIG. 7 shows an idle speed increase time map according to the embodiment of the invention. It should be noted that the idle speed increase time map shown in FIG. 7 is just an example. As shown in FIG. 7, only predetermined values of the fan operating time and the values of the idle speed increase time corresponding to the predetermined values of the fan operating time are stored in the form of the idle speed increase time map. The idle speed increase time corresponding to a fan operating time that is not set in the idle speed increase time map is interpolated based on the values of the fan operating time stored in the idle speed increase time map on the assumption that the idle speed increase time is directly proportional to the fan operating time. It should be noted that, in place of the idle speed increase time map as shown in FIG. 7, an equation to calculate the idle speed increase time, for example, may be set so as to able to deal with any values of the fan operating time.

Next, the ECU 100 determines whether the engine 17 is idling (in step S23). If it is determined in step S23 that the engine 17 is not idling (NO in step S23), the determination as to whether the engine 17 is idling is repeatedly made. On the other hand, if it is determined in step S23 that the engine 17 is idling (YES in step S23), the engine speed of the engine 17 is increased above a predetermined idle speed. In this way, the amount of electricity generated by the alternator 12 is increased so as to charge the battery 11.

Next, the ECU 100 determines whether the set idle speed increase time has elapsed (in step S25). If the set idle speed increase time has not elapsed yet (NO in step S25), the process returns to step S23, and the processes through step S23 to step S25 are repeated. On the other hand, if the set idle speed increase time has elapsed (YES in step S25), the fan operation control process performed when the engine 17 is restarted is terminated. In the embodiment, the processes through step S23 to step S25 function as a process of increasing the idle speed of the internal combustion engine according to the invention.

As described above, it is possible to set the idle speed increase time that varies in accordance with the set fan operating time, and to increase the idle speed of the engine 17 for only the set idle speed increase time.

As described above, the ECU 100 according to the embodiment sets the operating time of the electric fan 20 in accordance with the outside air temperature based on the fan operating time map, and also sets the idle speed increase time in accordance with the set fan operating time based on the idle speed increase time map. This makes it possible to easily calculate the fan operating time and the idle speed increase time for charging the battery 11, and further, this makes, it possible to reduce operations of the electric fan 20 that are not required and to shorten the idle speed increase time, whereby unnecessary operations are reduced. Thus, it is possible to suppress noise, and improve safety and extend the lifetime of the battery 11 by shortening the operating time.

Further, when the detected outside air temperature of the vehicle 10 does not match any temperature stored in the fan operating time map, the ECU 100 according to the embodiment calculates fan operating time corresponding to the detected outside air temperature based on other values of the fan operating time stored in the fan operating time map, whereby the fan operating time map according to the embodiment covers all the possible outside air temperatures even when the fan operating time map is not set to cover all the possible outside air temperatures. Further, it is possible to reduce the data size of the fan operating time map. As a result, it is impossible to reduce the capacity of memory required for storing the data in the ROM 100*b*.

As described above, in the fan operation control method and apparatus according to the invention, the fan operating time is set in accordance with the outside air temperature, and the idle speed increase time is set in accordance with the set fan operating time. Therefore, it is possible to easily calculate the fan operating time and the time required for charging the battery. Further, because it is possible to reduce unnecessary operations of the fan, etc., it is made possible to suppress noise, improve safety, and extend the lifetime of the battery. Consequently, the fan operation control method and apparatus according to the invention are useful as the fan operation control method and apparatus for controlling the operating time of the electric fan to cool the internal combustion engine after the internal combustion engine is stopped, and controlling the idle speed increase time to charge the battery.

A fan operation control method according to another embodiment may include: detecting an outside air temperature, and determining a fan operating time based on the detected outside air temperature; operating a fan for the determined fan operating time when an internal combustion engine is stopped; determining an idle speed increase time based on the fan operating time; and increasing the idle speed of the internal combustion engine for the determined idle speed increase time when the internal combustion engine is restarted.

A fan operation control apparatus according to yet another embodiment may include: a fan operating time setting portion that detects an outside air temperature, and determines a fan operating time based on the detected outside air temperature; a fan operation control portion that operates a fan for the determined fan operating time when an internal combustion engine is stopped; an idle speed increase time setting portion that determines an idle speed increase time based on the fan operating time; and an idle speed increase portion that increases the idle speed of the internal combustion engine for the determined idle speed increase time when the internal combustion engine is restarted.

The fan operating time may be set longer at a first outside air temperature, which is higher than a second outside air temperature, compared to the fan operating time at the second outside air temperature.

The fan operating time may be set constant when the outside air temperature is higher than the first outside air temperature.

The idle speed increase time may be set longer at the first outside air temperature, compared to the idle speed increase time at the second outside air temperature.

While the invention has been described with reference to example embodiments thereof, it is to be understood that the invention is not limited to the described embodiments or constructions. To the contrary, the invention is intended to cover various modifications and equivalent arrangements. In addition, while the various elements of the disclosed invention are shown in various example combinations and configurations, other combinations and configurations, including more, less or only a single element, are also within the scope of the appended claims.

What is claimed is:

1. A fan operation control method, comprising:

storing a fan operating time map based on which an operating time of a fan is set in accordance with an outside air temperature of a vehicle and an idle speed increase time map based on which an idle speed increase time is set in accordance with the operating time of the fan;

detecting the outside air temperature of the vehicle;

detecting an operation stop command of an internal combustion engine that is cooled by the fan;

setting the operating time of the fan in accordance with the outside air temperature of the vehicle based on the fan operating time map when the operation stop command of the internal combustion engine is detected;

storing the set operating time of the fan in a non-volatile memory;

controlling the fan to operate for the set operating time of the fan using electric power supplied from a battery;

detecting an operation start command of the internal combustion engine;

searching the non-volatile memory when the operation start command of the internal combustion engine is detected, and setting time to increase an idle speed in accordance with the set operating time of the fan based on the idle speed increase time map when the operating time of the fan is set; and increasing the idle speed of the internal combustion engine in accordance with the set time to increase the idle speed so as to charge the battery.

2. The fan operation control method according to claim 1, wherein when the operating time of the fan is set in accordance with the outside air temperature of the vehicle, if the detected outside air temperature of the vehicle does not match any value set in the fan operating time map, the operating time of the fan corresponding to the detected outside air temperature is interpolated based on an operating time corresponding to another outside air temperature set in the fan operating time map.

3. A fan operation control apparatus, comprising:

an operating time map storing portion configured to store a fan operating time map based on which an operating time of a fan is set in accordance with an outside air temperature of a vehicle and an idle speed increase time map based on which an idle speed increase time is set in accordance with the operating time of the fan;

an outside air temperature detection portion configured to detect the outside air temperature of the vehicle;

an internal combustion engine operation command detection portion configured to detect an operation stop command and an operation start command of an internal combustion engine that is cooled by the fan;

a fan operating time setting portion configured to set the operating time of the fan in accordance with the outside air temperature of the vehicle based on the fan operating time map when the operation stop command of the internal combustion engine is detected;

a fan operating time storing portion configured to store the set operating time of the fan in a non-volatile memory;

a fan operation control portion configured to control the fan to operate for the set operating time of the fan using electric power supplied from a battery;

an idle speed increase time setting portion configured to search the non-volatile memory when the operation start command of the internal combustion engine is detected, and that sets time to increase an idle speed in accordance with the set operating time of the fan based on the idle speed increase time map when the operating time of the fan is set; and an idle speed increase portion configured to increase the idle speed of the internal combustion engine in accordance with the set time to increase the idle speed so as to charge the battery.

* * * * *